US006275195B1

(12) United States Patent
Gyenes

(10) Patent No.: US 6,275,195 B1
(45) Date of Patent: Aug. 14, 2001

(54) FREQUENCY ADJUSTABLE MOBILE ANTENNA

(76) Inventor: Charles M. Gyenes, 21085 Cielo Vista Way, Wildomar, CA (US) 92595-8524

( * ) Notice: Subject to any disclaimer, the term of this patent is extended or adjusted under 35 U.S.C. 154(b) by 0 days.

(21) Appl. No.: 09/480,615

(22) Filed: Jan. 10, 2000

(51) Int. Cl.[7] ..... H01Q 9/00
(52) U.S. Cl. ..... 343/745; 343/750
(58) Field of Search ..... 343/745, 711, 343/715, 723, 895

(56) References Cited

U.S. PATENT DOCUMENTS 2,719,920 * 10/1955 Ellis ..... 343/745
3,264,647 * 8/1966 Nuttle ..... 343/745
4,958,163 * 9/1990 Leonard ..... 343/745
6,137,452 * 10/2000 Sullivan ..... 343/873

* cited by examiner

*Primary Examiner*—Don Wong
*Assistant Examiner*—James Clinger
(74) *Attorney, Agent, or Firm*—William L. Chapin

(57) ABSTRACT

A frequency adjustable antenna for transceivers operable at different frequencies, having electrically isolated fixed and extensible mast sections separated by a loading coil in continuity with the fixed mast section and insulated from the extensible mast section and a contactor carried by the extensible mast section commutating with the loading coil for tuning the frequency response of the antenna; and a servo for remote extension and retraction of the extensible mast section selectively positioned thereby.

15 Claims, 3 Drawing Sheets

FREQUENCY ADJUSTABLE MOBILE ANTENNA

BACKGROUND

This invention relates to radio transceiver antennas that must be tuned to the radio Frequency (RF) being used, transceivers being very sensitive to antenna performance and Voltage Standby Wave Ratio (VSWR) and with capacity to efficiently radiate the transmitter power output under all conditions. Such antennas are employed universally by Maritime, Aviation, Military and Government services, and by the general public as well, and it is the mobility of the transceiver and its antenna which is the focal point of this invention.

It is the High Frequency (HF) range of radio transmission with which this invention is particularly concerned, although it is to be understood that the tuning concept herein disclosed is equally applicable to other radio frequency ranges as may be required. With respect to the HF range covering 1.6 to 30 $MH_z$ frequencies the size and /or length of the antenna becomes a controlling factor. Assuming that the transceiver is installed on and transported by a moving vehicle, clearance along most highways and roadways is 14 feet, whereas the optimum vertical height of a properly tuned antenna can far exceed said highway or roadway clearance. Therefore, it is an object of this invention to increase and decrease the tuned antenna length (as distinguished from height), without limit with respect to highway and/or roadway vertical clearance.

Heretofore, RF antennas have been tuned by means of loading the same with coils that extend their effective length without extending the height thereof. In practice, individual coils have been employed and installed for each radio frequency to be matched. Or, complicated and expensive Antenna Tuners have been used, but they are bulky extra equipment. It is therefore a general object of this invention to fine tune the antenna per se to any radio frequency within a specified range, and in this disclosure the practical High Frequency HF range from 3.5 to 30 $MH_z$. In practice, the antenna is center loaded with a coil and contactor that adjustably extends the effective length of the antenna.

It is an object of this invention to provide a remote controlled servo by which the antenna can be adjustably tuned from the transceiver location. And, it is still another object of this invention to provide matching impedance of the antenna by means of a shunt to ground, as will be described.

It is omni tuning of a mobile transceiver antenna which is here of concern, accuracy of adjustment being a prime object, and to this end the center loading coil that characterizes this antenna frequency adjustment is supported with accuracy with respect to the coil pitch and is associated with an axially positioned contactor locked in selected placement by a remotely controlled servo motor. The coil and contactor combination cannot drift from the selected placement by the servo motor and self locking elevator nut combination, as will be described.

The foregoing and various other objects and features of this invention will be apparent and fully understood from the following detailed description of the typical preferred forms and applications thereof, throughout which description reference is made to the accompanying drawings.

THE DRAWINGS

FIG. 1 is a vertical view of a typical frequency adjustable antenna embodiment of the present invention.

FIG. 2. is an enlarged view of the frequency adjustable center loading coil and shiftable contactor, illustrating the fixedly positioned lower mast section and the extensible upper mast section.

PREFERRED EMBODIMENT

Figure 1:
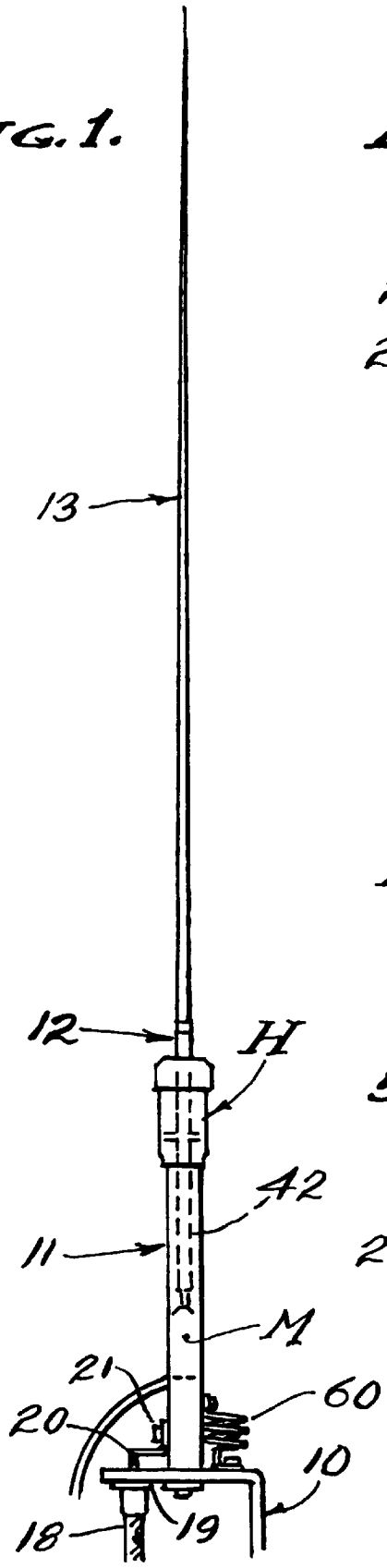
Figure 2:
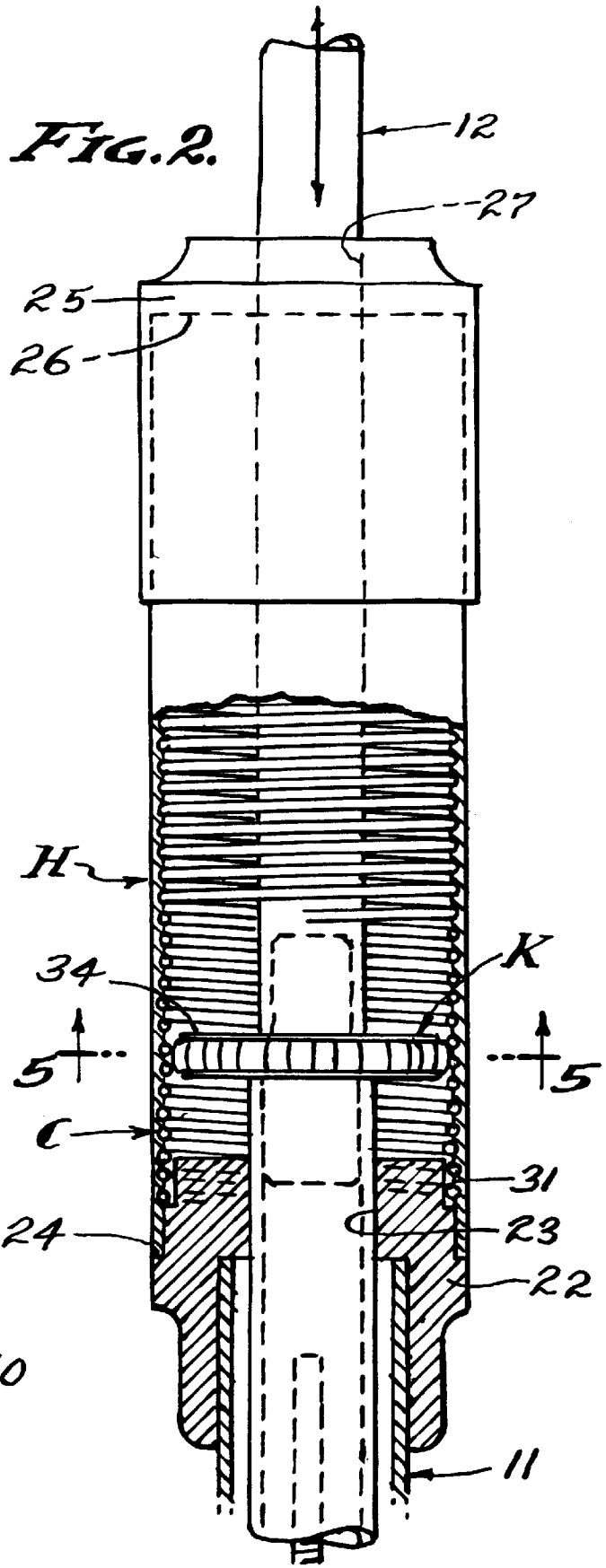

Referring now to the drawings, This mobile antenna is vertically disposed when installed for use on a vehicle or the like bracket 10, and is comprised generally of a sectional mast having a lower mounted section 11 and an upper extensible section 12 to which a replaceable whip section 13 is attached. These three sections are electrically conductive and separated by an insulating housing H that positions a center loading coil C intermediate the mast sections 11 and 12 and coaxially guides said sections, there being an adjustable contactor K carried by the upper mast section 12 for commutation with said loading coil C and positioned by elevator means E. The electrically conductive elements of the antenna are the mast sections 11, 12 and 13, the coil C and the contactor K, all other elements being non-conductive and/or isolated electrically from the conductive antenna elements.

Figure 3:
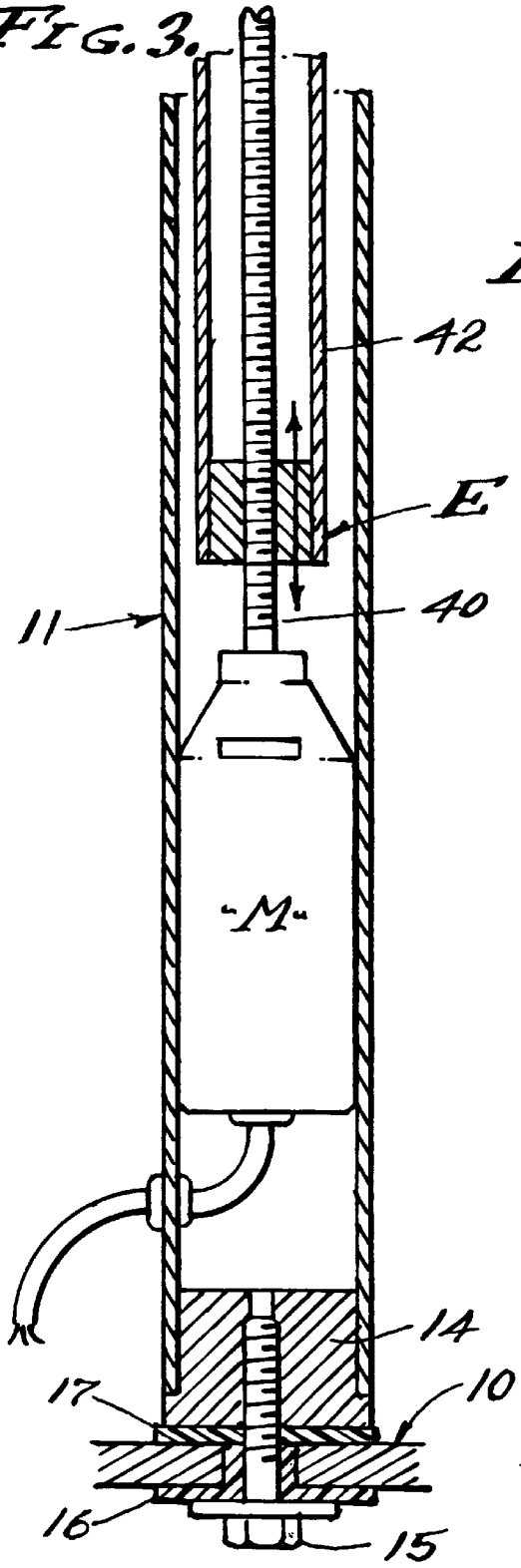
FIG. 3 is an extension of FIG. 2 into the lower mast section.
Figure 4:
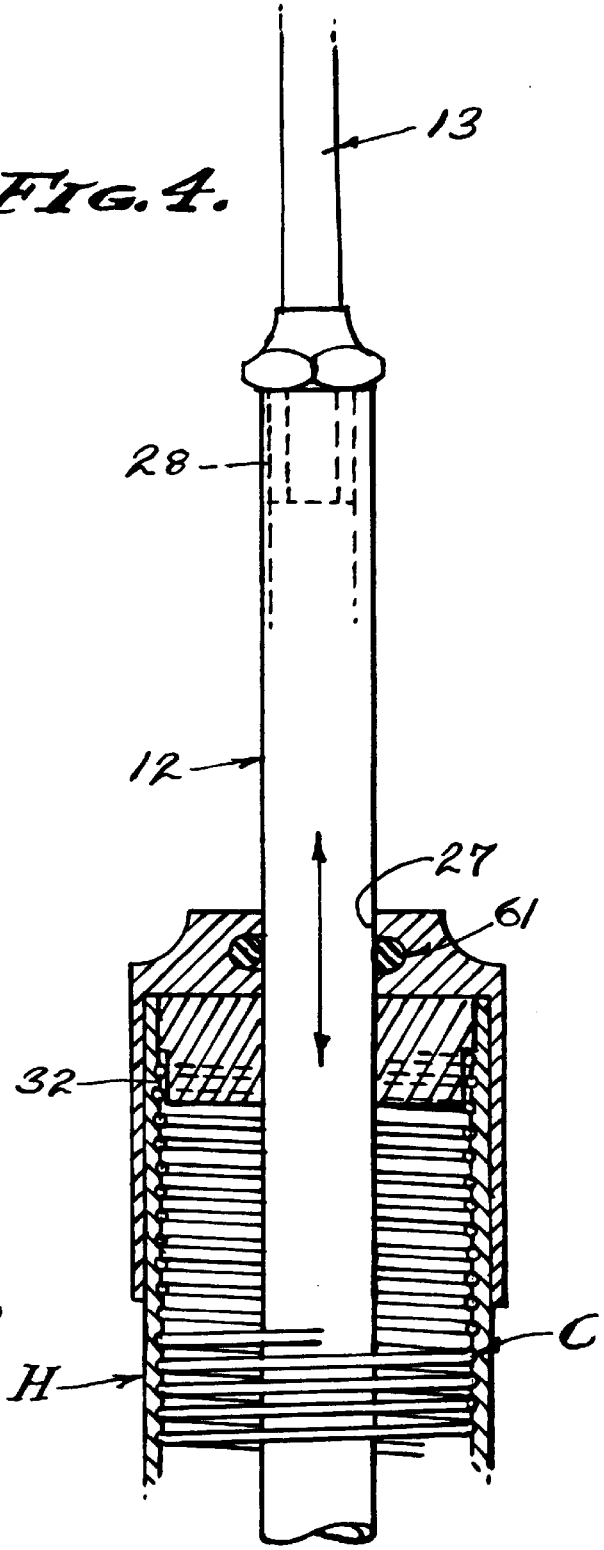
FIG. 4 is an extension of FIG. 2 into the upper mast section.
Figure 5:
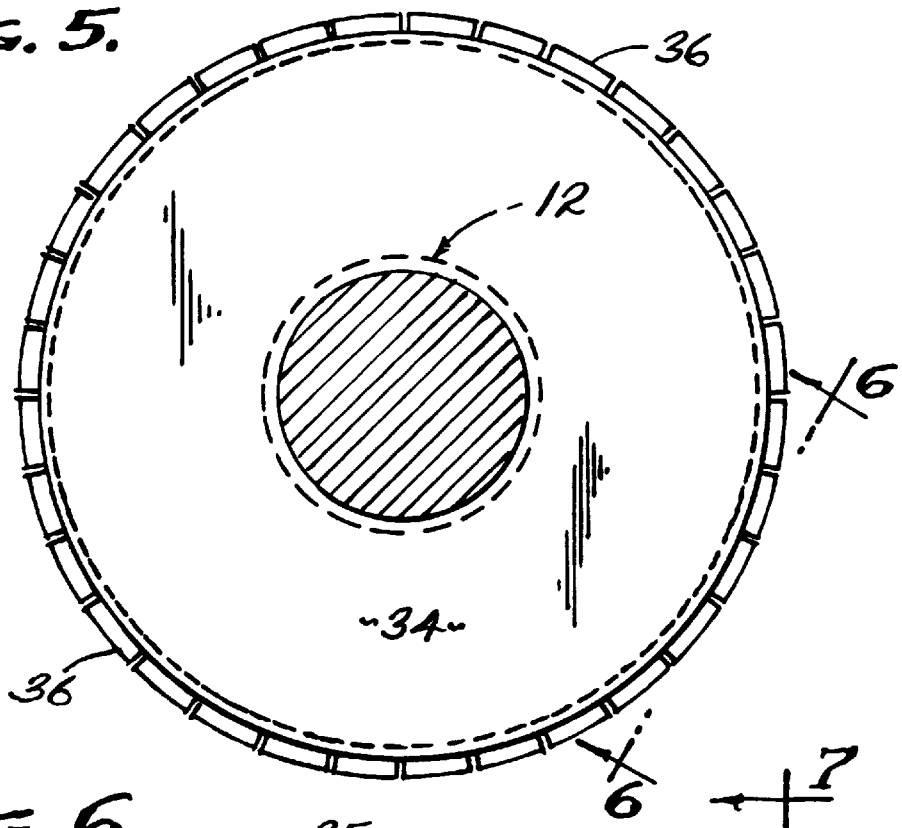
FIG. 5 is an enlarged cross section view taken as indicated by line 5—5 on FIG. 2, showing a preferred contactor means.
Figure 6:
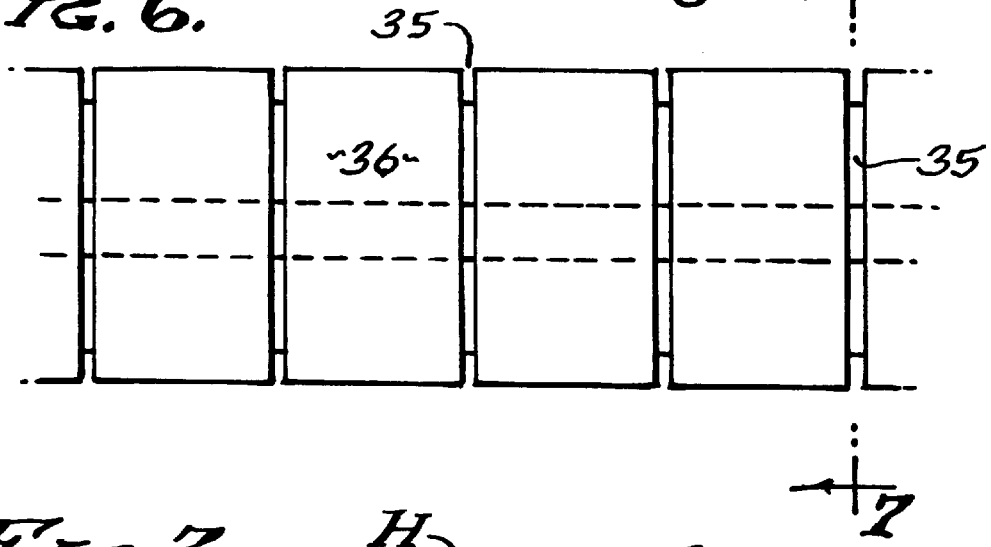
FIG. 6 is a greatly enlarged lineal section of the preferred resilient contactor means. And, FIG. 7 is a cross section taken as indicated by line 7—7 on FIG. 6, showing the adjustable contact with the loading coil protectively carried within the housing, as will be described.

Referring to the lower mast section 11, this is the mounted portion of the antenna secured to a horizontal plate of the bracket 10 by means of a base 14 secured into the tubular section 11 and fastened to bracket 10 as by a cap screw 15 extending through insulating bushing 16 and washer 17 as shown in FIG. 3. Accordingly, the lower mast section is electrically isolated to receive radio frequency RF power from a coaxial cable 18 grounded at 19 with a single power conductor 20 connected to the mast section 11 at 21. In practice, the mast section 11 is approximately 2 inches diameter and its height can vary from 2 to 5 feet, the preferred mast section 11 being 3 feet from top to bottom. The top of the tubular mast section 11 is closed by a cap 22 of conductive material secured thereto and having a concentric guide opening 23, and housing H and coil C mounting features.

Referring to the electrically insulated housing H, a feature which characterizes this invention, in its simplified and preferred form is a cylinder of dielectric material, preferably a clear polycarbonate seated concentrically in the aforementioned mounting feature of the cap 22 and positioned against a shoulder 24 to extend vertically from the conductive cap 22 and from the conductive top terminal end of mast section 11. In practice, the housing is approximately 3 inches diameter and 9 inches high, closed at its bottom by cap 22. The top of the cylindrical housing is closed by a non-conductive cap 25 secured thereto against a shoulder 26 and having a concentric guide opening 27, and housing H and coil C mounting features.

Referring to the upper mast section 12, this is the adjusted end of the antenna that selectively extends its physical height approximately 8 inches while increasing the adjusted tuned frequency length of the antenna approximately 66 feet at 3.8 $MH_z$, from its original 13½ foot height. The mast section 12 is slidably received by and reciprocates through the guide opening 27 of the insulating cap 25. The upper mast section 12 is a tubular member of electrically conductive material approximately one (1) inch diameter and preferably 12 inches high closed by top plug 28 threaded to detachably receive the whip section 13 of a length to reach the aforesaid physical antenna height of 13½ feet.

In accordance with this invention the center loading coil C is protectively positioned within the cylindrical housing H and characterized by helically separated convolutions of uniform pitch diameter anchored externally at top and bottom ends by the housing H and exposed internally to the contactor K as will be described. In practice, the pitch diameter of the coil C is 2.75 inches and coincidental with the inner diameter of the housing H, in which case each convolution thereof represents 8.639 lineal inches, there being 72 turns of coil in 8 inches, utilized for tuning between 3.5 and 30 $MH_z$, the coil C having a pitch of 9 turns per inch. Accordingly, the lineal tuning capacity is 72 turns of coil resulting in a total lineal extension capacity of 622 inches or 51.834 feet. Therefore, the complete assembly having a total mast-whip height of 13½ feet can be fine tuned to 3.5 $MH_z$ when the contact disc 34 later described is extended to the top of said active 8 inches of useful coil C. Whereas, said complete assembly can be retracted 8 inches and fine tuned to 30 $MH_z$ at the top of said active 8 inches of useful coil C.

In practice, the height of the whip section 13 may be reduced so as to restrict the antenna height to said 13½ feet (practical maximum) above the road pavement level, the base of the mast section 11 being mounted at vehicle bumper level approximately 12 to 18 inches above the road pavement level. This variation in antenna base height is inherently compensated for when tuning the coil C with contacter K, restricting top end tuning but slightly.

There is a performance radiation efficiency that results in a feed-point impedance, in this instance of 52 Ohms, which is balanced by a 52 Ohm shunt 60 to ground at the base of mast section 11 connected to the grounded mounting bracket 10.

Figure 7:
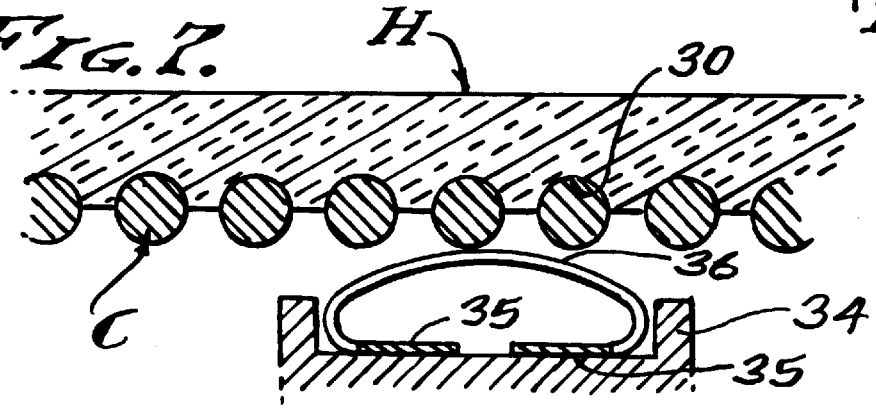

As shown best in FIG. 7, the inner diameter of the cylindrical housing H is threadedly grooved at 30 to match the semicircular outer cross section of the coil wire which is formed of #14 gage hard drawn copper that is silver plated for conductivity, the pitch diameter of the semi-circular groove being coincidental with the inner diameter of the housing H. The mounting feature in caps 22 and 25 includes shouldered seats 31 and 32 firmly receiving and positioning the inner diameter of coil C at the top and bottom ends of the housing H. Note that the bottom end of coil C is electrically connected through the conductive cap 22 to the lower mast section 11, and that the top end of the coil C is insulated electrically from the conductive upper mast section 12.

Referring now to the contactor means K carried by the upper mast section 12, the number of coil turns made active between the lower and upper mast sections is determined by the height or elevated position of a contactor disc 34 within the coil C. In its simplified and preferred form the contactor means K is a peripheral series of radially yieldable contacts 36 carried coaxially with the mast sections 11 and 12 by the electrically conductive contactor disc 34 with the lower conductive end of the upper mast section 12. In practice, a circumferential spring strip of resilient Beryllium Copper comprised of spaced supporting band members 35 with a multiplicity of next adjacent radially arched tabs 36 in a circumferential series extending between bands 35 and bearing outwardly for presenting radially disposed contact faces. The bands 35 and integral arched tabs 36 are captured within axially spaced peripheral flanges of the contactor disc 34, see FIG. 7. The tabs 36 are individually depressible radially inward, whereby the series of circumferentially adjacent contact surfaces thereof engageably embrace a substantial sector of any one coil convolution when axially positioned between the top and bottom of the coil C, thereby determining the adjusted effective tuned length of the antenna.

Referring to the elevator means E, a reversible gear-head servo motor M is housed within the lower portion of the tubular mast section 11, from which an elevator screw 40 extends upward and coaxially to threadedly engage a nut 41 carried at the lower end of an extension tube 42 of insulation material slidably passing through the guide opening 23 in cap 22 and affixed to the contactor disc 34 (see FIG. 3) to raise and lower the same. Note that the lower mast section 11 is frictionally engaged through the guide opening 23 in cap 22, that the upper section 12 is frictionally engaged through the guide opening 26 in cap 25, and at the contactor disc 34 contact tabs 36 are frictionally engaged within the coil C, there being an "O" ring weather seal 61, all of which frictionally prevents turning of the elevator means nut 41, whereby the elevator screw 40 of small diameter, compared with the aforesaid frictional engagements, revolves freely within the nut 41 to raise and lower the contactor disc 34.

Having described only the preferred forms and applications of my invention, I do not wish to be limited or restricted to the specific details herein set forth, but wish to reserve to myself any modifications or variations that may appear to those skilled in the art as set forth within the limits of the following claims.

I claim:

1. A frequency adjustable antenna for transceivers operable at different radio frequencies comprising:

m. a lower electrically conductive base mast section with a radio frequency connection thereto, n. an upper electrically conductive extensible mast section insulated electrically from said base mast section and adapted to hold in electrical contact therewith an elongated conductive whip, o. an elongated hollow cylindrical housing made of an electrically non-conductive material and having formed in an inner cylindrical wall surface thereof a longitudinally disposed helical groove, p. an electrically conductive loading coil comprised of a conductor formed into spaced convolutions comprising a helix of the same pitch as said helical groove in said housing, and fitting within said groove with an inner cylindrical surface of said helix located radially inward of said inner cylindrical wall surface of said housing, q. a contactor means carried by and electrically connected to said upper mast section for commutation with said spaced coil convolutions, said contactor means comprising a disk of electrically conductive material affixed to said upper electrically conductive mast section, said disk having protruding radially outwardly thereof a circumferential spring member comprised of a pair of axially spaced apart circumferential supporting band members having disposed axially therebetween a plurality of circumferentially spaced apart, adjacent arched tabs resiliently biased radially outwardly to contact a substantial sector of at least one coil convolution, and r. elevator means for raising and lowering said extensible mast section and said contactor means for selective commutation with said coil convolutions, thereby increasing and decreasing the tuned frequency length of the combined coil and two mast sections.

2. The frequency adjustable antenna of claim 1 wherein said coil convolutions are coaxial with said contactor means for coil commutation.

3. The frequency adjustable antenna of claim 1 wherein said coil convolutions are coaxial with said cylindrical housing.

4. The frequency adjustable antenna of claim 3, wherein said cylindrical housing is coaxial with and projects upwardly from said lower base mast section, and wherein said coil convolutions are coaxial with said contactor means for coil commutation.

5. The frequency adjustable antenna of claim 4, wherein said upper extensible mast section is coaxial with said lower base mast section.

6. The frequency adjustable antenna of claim 1 wherein said housing is carried by a lower base cap of electrically conductive material supported by said base mast section.

7. The frequency adjustable antenna of claim 6, wherein said upper extensible mast section is guided coaxially with said lower base mast section by a guide opening in an upper cap supported by said cylindrical housing.

8. The frequency adjustable antenna of claim 1, wherein said lower base mast section is tubular, and wherein said elevator means is comprised of a reversible motor housed within a lower portion of said lower base mast section and from which an extension of insulating material extends upwardly and is affixed to said contactor means, there being a nut carried by said extension and threadedly engaged over an elevator screw reversibly driven by said motor.

9. The frequency adjustable antenna of claim 1, wherein said contactor means is comprised of a disk of electrically conductive material affixed to said upper electrically conductive mast section, said disk having protruding radially outwardly thereof a circumferential spring member comprised of a pair of axially spaced apart circumferential supporting band members having disposed axially therebetween a plurality of circumferentially spaced apart, adjacent arched tabs resiliently biased radially outwardly to contact a substantial sector of at least one coil convolution.

10. The frequency adjustable antenna of claim 1, wherein said contactor means is comprised of a disk of electrically conductive material electrically conductively coupled to said upper electrically conductive mast section, said disk having affixed thereto an electrically conductive circumferential spring member comprised of a single longitudinally elongated rectangularly shaped strip of resilient conductive material, upper and lower longitudinal edges of which are bent rearwardly from a front, outer surface of said strip and thence axially inwardly towards a longitudinal center line of said strip to form two axially spaced apart, rear, inner longitudinally disposed supporting band members, the outer, front surface of said strip continuous with said supporting band members formed into an arcuately curved, convex arched surface segmented by a plurality of transversely disposed slits spaced apart at regular longitudinal intervals into a plurality of longitudinally spaced apart arched tabs, said strip being bent into a ring-shaped loop having an axially disposed curvature axis coaxial with said disk to thereby arrange said tabs into a circumferential array having convex outer surfaces resiliently biased radially outwardly to contact a substantial sector of at least one coil convolution.

11. A frequency adjustable antenna for transceivers operable at different radio frequencies comprising;

a. a lower electrically conductive base mast section with a radio frequency connection thereto, b. an upper electrically conductive extensible mast section insulated electrically from said base mast section and adapted to hold in electrical contact therewith an elongated conductive whip, c. an elongated hollow cylindrical housing made of an electrically non-conductive material, d. an electrically conductive loading coil housed within said housing comprised of spaced convolutions and electricity connected to said lower base mast section, and e. contactor means carried by and electrically connected to said upper mast section for commutation with said spaced coil convolutions, said contactor means comprising a disk of electrically conductive material affixed to said upper electrically conductive mast section, said disk having protruding radially outwardly thereof a circumferential spring member comprised of a pair of axially spaced apart circumferential supporting band members having disposed axially therebetween a plurality of circumferentially spaced apart, adjacent arched tabs resiliently biased radially outwardly to contact a substantial sector of at least one coil convolution.

12. A frequency adjustable antenna for transceivers operable at different radio frequencies comprising;

a. a lower electrically conductive base mast section with a radio frequency connection thereto, b. an upper electrically conductive extensible mast section insulated electrically from said base mast section and adapted to hold in electrical contact therewith an elongated conductive whip, c. an elongated hollow cylindrical housing made of an electrically non-conductive material, d. an electrically conductive loading coil housed within said housing comprised of spaced convolutions and electricity connected to said lower base mast section, and e. contactor means comprised of a disk of electrically conductive material electrically conductively coupled to said upper electrically conductive mast section, said disk having affixed thereto an electrically conductive circumferential spring member comprised of a single longitudinally elongated rectangularly shaped strip of resilient conductive material, upper and lower longitudinal edges of which are bent rearwardly from a front, outer surface of said strip and thence axially inwardly towards a longitudinal center line of said strip to form two axially spaced apart, rear, inner longitudinally disposed supporting band members, the outer, front surface of said strip continuous with said supporting band members formed into an arcuately curved, convex arched surface segmented by a plurality of transversely disposed slits spaced apart at regular longitudinal intervals into a plurality of longitudinally spaced apart arched tabs, said strip being bent into a ring-shaped loop having an axially disposed curvature axis coaxial with said disk to thereby arrange said tabs into a circumferential array having convex outer surfaces resiliently biased radially outwardly to contact a substantial sector of at least one coil convolution.

13. In a frequency adjustable antenna for transceivers operable at different radio frequencies and including an electrically conductive loading coil comprised of space convolutions and contactor means for commutation with said spaced coil convolutions, the improvement comprising said contactor means including a disk having protruding radially outwardly thereof a circumferential spring member comprised of a pair of axially spaced apart circumferential supporting band members having disposed axially therebetween a plurality of circumferentially spaced apart, adjacent arched tabs resiliently biased radially outwardly to contact a substantial sector of at least one coil convolution.

14. A frequency adjustable antenna for transceivers operable at different radio frequencies comprising:

g. a lower electrically conductive base mast section with a radio frequency connection thereto, h. an upper electrically conductive extensible mast section insulated electrically from said base mast section and adapted to hold in electrical contact therewith an elongated conductive whip, i. an elongated hollow cylindrical housing made of an electrically non-conductive material and having formed in an inner cylindrical wall surface thereof a longitudinally disposed helical groove, j. an electrically conductive loading coil comprised of a conductor formed into spaced convolutions comprising a helix of the same pitch as said helical groove in said housing, and fitting within said groove with an inner cylindrical surface of said helix located radially inward of said inner cylindrical wall surface of said housing, k. a contactor means carried by and electrically connected to said upper mast section for commutation with said spaced coil convolutions, said contactor means comprising a disk of electrically conductive material electrically conductively coupled to said upper electrically conductive mast section, said disk having affixed thereto an electrically conductive circumferential spring member comprised of a single longitudinally elongated rectangularly shaped strip of resilient conductive material, upper and lower longitudinal edges of which are bent rearwardly from a front, outer surface of said strip and thence axially inwardly towards a longitudinal center line of said strip to form two axially spaced apart, rear, inner longitudinally disposed supporting band members, the outer, front surface of said strip continuous with said supporting band members formed into an arcuately curved, convex arched surface segmented by a plurality of transversely disposed slits spaced apart at regular longitudinal intervals into a plurality longitudinally spaced apart arched tabs, said strip being bent into a ring-shaped loop having an axially disposed curvature axis coaxial with said disk to thereby arrange said tabs into a circumferential array having convex outer surfaces resiliently biased radially outwardly to contact a substantial sector of at least one coil convolution, and l. elevator means for raising and lowering said extensible mast section and said contactor means for selective commutation with said coil convolutions, thereby increasing and decreasing the tuned frequency length of the combined coil and two mast sections.

15. The frequency adjustable antenna of claim 14 wherein said conductive material of said strip is further defined as being a beryllium copper alloy.

* * * * *